US006803532B1

(12) United States Patent
Lee

(10) Patent No.: US 6,803,532 B1
(45) Date of Patent: Oct. 12, 2004

(54) MULTI-POSITIONAL SWITCH FOR AIRCRAFT

(76) Inventor: Kyea Kwang Lee, 256-8 In-Dong, Dong Gu, Daejeon (KR)

( * ) Notice: Subject to any disclaimer, the term of this patent is extended or adjusted under 35 U.S.C. 154(b) by 0 days.

(21) Appl. No.: 10/803,299

(22) Filed: Mar. 19, 2004

(51) Int. Cl.[7] ..... H01H 25/04
(52) U.S. Cl. ..... 200/6 A; 200/4
(58) Field of Search ..... 200/4, 6 A, 17 R, 200/18

(56) References Cited

U.S. PATENT DOCUMENTS

| | | | | |
|---|---|---|---|---|
| 3,539,736 A | | 11/1970 | Naimer | |
| 3,772,484 A | | 11/1973 | Roeser | |
| 4,230,916 A | * | 10/1980 | Mochizuki | 200/6 A |
| 4,308,434 A | * | 12/1981 | Roeser | 200/6 R |
| 4,466,302 A | | 8/1984 | Harris | |
| 4,758,692 A | * | 7/1988 | Roeser et al. | 200/6 A |
| 4,939,327 A | | 7/1990 | Wu et al. | |
| 5,057,657 A | | 10/1991 | Skulic | |
| 5,227,594 A | * | 7/1993 | Russo | 200/6 A |
| 5,907,138 A | | 5/1999 | Metzler | |
| 5,945,647 A | | 8/1999 | Hoskins | |
| 6,160,225 A | * | 12/2000 | Isikawa | 200/4 |
| 6,720,504 B2 | * | 4/2004 | Nishimoto et al. | 200/4 |

* cited by examiner

*Primary Examiner*—Michael A. Friedhofer

(57) ABSTRACT

A multi-positional switch that provides an immediate tactile sensation to the operator regarding the various switching positions of the switch through touch sensing includes a push button mounted to a housing which is capable of being depressed and toggled for moving a drive stem interconnected thereto into electrical engagement with either axial or radially disposed contact terminals projecting from the lower end of the housing. A toggle plate is mounted within the housing and provides a surface for the drive stem to ride upon and provide resistance in order to contact the radially disposed terminals when the push button is toggled, while depression of the push button in the axial direction causes the drive stem to pass through an aperture of the toggle plate, forcibly contacting and passing by a resistance pin subjacent the toggle plate for engaging an axial mounted terminal for conveying the tactile feel to the operator.

20 Claims, 6 Drawing Sheets

MULTI-POSITIONAL SWITCH FOR AIRCRAFT

BACKGROUND OF THE INVENTION

The present invention pertains to a multi-positional switch for the controls of an aircraft, and, more particularly, pertains to a multi-positional electrical switch for providing tactile feedback to the operator of the various switch positions.

Switches, such as push button and toggle switches, are found in everything from cameras and computer keyboards, power tools and home appliances, automotive vehicles and industrial machinery. For the above uses, as well as numerous other uses, the operator has the opportunity and time to visually observe the position of the various operational and control switches at any moment in order to confirm the particular state, engaged or disengaged, of the switch, and to obtain assurance in the form of immediate visual feedback that the switch or switches are in their proper position.

However, in certain work environments it may not be possible or desirable for the user or operator to carefully view and inspect the particular position of the switch due to safety and operational requirements. One example of such a work environment is in the operation and control of aircraft where the pilot, co-pilot or navigator must maintain constant vigilance in order to avoid even the slightest distraction that could lead to a fatal error and a devastating accident. Many of the switches used in aircraft are multi-contact switches wherein accuracy and stability are prerequisites for proper functioning in order for the operator to easily and accurately determine the state the particular switch is in.

In general a five-way switch is utilized as the conventional type of switch for aircraft. Such conventional five-way switches are configured to allow the operator to instantly sense and perceive the act and condition of switching through the perception of sounds produced by the switch contacts. However, an acute drawback in the perception of such sounds at the actual moment of switching is that the intense noise in the cockpit, combined with the fact that the operators are often wearing headsets, thoroughly obstructs the distinct perception of the switching sounds. Therefore, it is necessary for the flight operators to reliably sense the individual switching states solely through the tactile sense.

Thus, a number of switches have been conceived for providing a tactile and/or audible sense or feeling to the operator or user of the equipment. The Harris patent (U.S. Pat. No. 4,466,302), the Wu et al. patent (U.S. Pat. No. 4,939,327), and the Skulic patent (U.S. Pat. No. 5,057,657) all disclose keyboard switches. Harris discloses a switch actuation mechanism utilizing a stem for contacting cammed surfaces that in turn engage a rocking plate member for initiating electrical energization while Wu et al. utilizes a reciprocable plunger that actuates a leaf spring and an actuating arm for producing a tactile sense and Skulic discloses a switch actuator mechanism utilizing a cooperating plunger and slide member to create the tactile sense or feeling.

The Naimer patent (U.S. Pat. No. 3,539,736) discloses a switch having a reciprocable shaft with cam elements adjoined thereto, and the cam elements actuating independently shiftable armatures.

The Roeser patent (U.S. Pat. No. 3,772,484) discloses a dual action electrical switch wherein an actuator engages a pair of pivotally mounted switch levers for engaging the dual action switch.

The Metzler patent (U.S. Pat. No. 5,907,138) discloses a push-button switch having a reciprocable rod that successively engages spring biased stops each of which corresponds to an electrical contact for initiating electrical conduction.

The Hoskins patent (U.S. Pat. No. 5,945,647) discloses an electrical control apparatus having a control member that can establish an electrical circuit by either rotary or axial motion.

Nonetheless, despite the ingenuity of the above devices, there remains a need for a multi-positional switch that provides reliable, accurate, and immediate tactile feedback to the operator regarding the various switch positions to which the switch has been shifted or toggled.

SUMMARY OF THE INVENTION

The present invention comprehends a multi-positional electrical switch for use in aircraft in order to provide an immediate tactile sensation and tactile feedback to the operator regarding the various switching positions to which the switch has been moved.

The present invention includes a generally cylindrical housing having a manually displaceable push button mounted at the upper end of the housing. Projecting out of the lower end of the housing can be one or more radially disposed terminals and a central terminal. In addition, auxiliary contacts are adjoined to the terminals, and each auxiliary contact includes a bent portion adjacent a drive stem when the drive stem is in a non-actuated state. Secured to the push button and located at the upper end of the housing therein is a deformable cap. A guide shaft is axially mounted to the cap and includes a bore for receiving therein the drive stem that can be actuated for linear, slidable reciprocable movement and radial motion within the housing by operation of the push button. A pair of sleeves is disposed within the housing for delimiting the range of axial and radial motions of the guide shaft and drive stem. An L-shaped common terminal member is disposed adjacent the lower end of the housing and includes a rectilinear portion extending outwardly from the end of the housing and a circular portion disposed within the housing and below the guide shaft. The circular portion includes an aperture through which the drive stem can extend. Confined between an interior flange of the guide shaft and the circular portion of the common terminal member is a compression spring.

Closing off the lower end of the housing is a lower enclosure plate, and the lower enclosure plate supports the central terminal. The central terminal protrudes outwardly from the lower enclosure plate and is in general axial alignment with the drive stem when the push button is in the non-operational state. Disposed within the housing and supported on the lower enclosure plate is a toggle or shifting plate. The toggle plate also has an aperture through which the drive stem can extend when the push button is actuated. Located immediately below the toggle plate is a spring-mounted resistance pin for offering resistance to the drive stem as the drive stem passes through the aperture of the toggle plate for contacting the central terminal.

By manipulating the push button the operator can move the drive stem against the toggle plate in a radial direction so that the drive stem contacts the auxiliary contacts for electrical energization and switching. When the operator applies a downward force in the axial direction, the drive stem is forced through the aperture of the toggle plate contacting and overcoming the resistance of the resistance pin, which the operator perceives by through the tactile sense alone. Further downward pressure by the operator's finger applied to the push button causes the drive stem to contact the central terminal.

It is an objective of the present invention to provide a multi-positional switch that provides an easy and immediate perception to the operator of the particular switching state of the switch through tactile sensation alone.

It is another objective of the present invention to provide a multi-positional switch which can be moved and toggled in both axial and radial directions and which conveys the tactile sense to the operator when external pressure exceeds a predetermined limit is applied to the switch.

These and other objects, features, and advantages will become apparent to one skilled in the art upon a perusal of the following detailed description and accompanying drawings.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DETAILED DESCRIPTION OF THE PREFERRED EMBODIMENT

Illustrated in FIGS. 1–10 is a multi-positional switch 10 for aircraft that provides the operator with immediate feedback on the particular switching state of the switch by means of tactile sensations in the form of touch sensing of the switch 10. The present invention is a 5-way switch that conveys immediate tactile sensations to the operator when the operator applies a given pressure to the switch 10.

Figure 1:
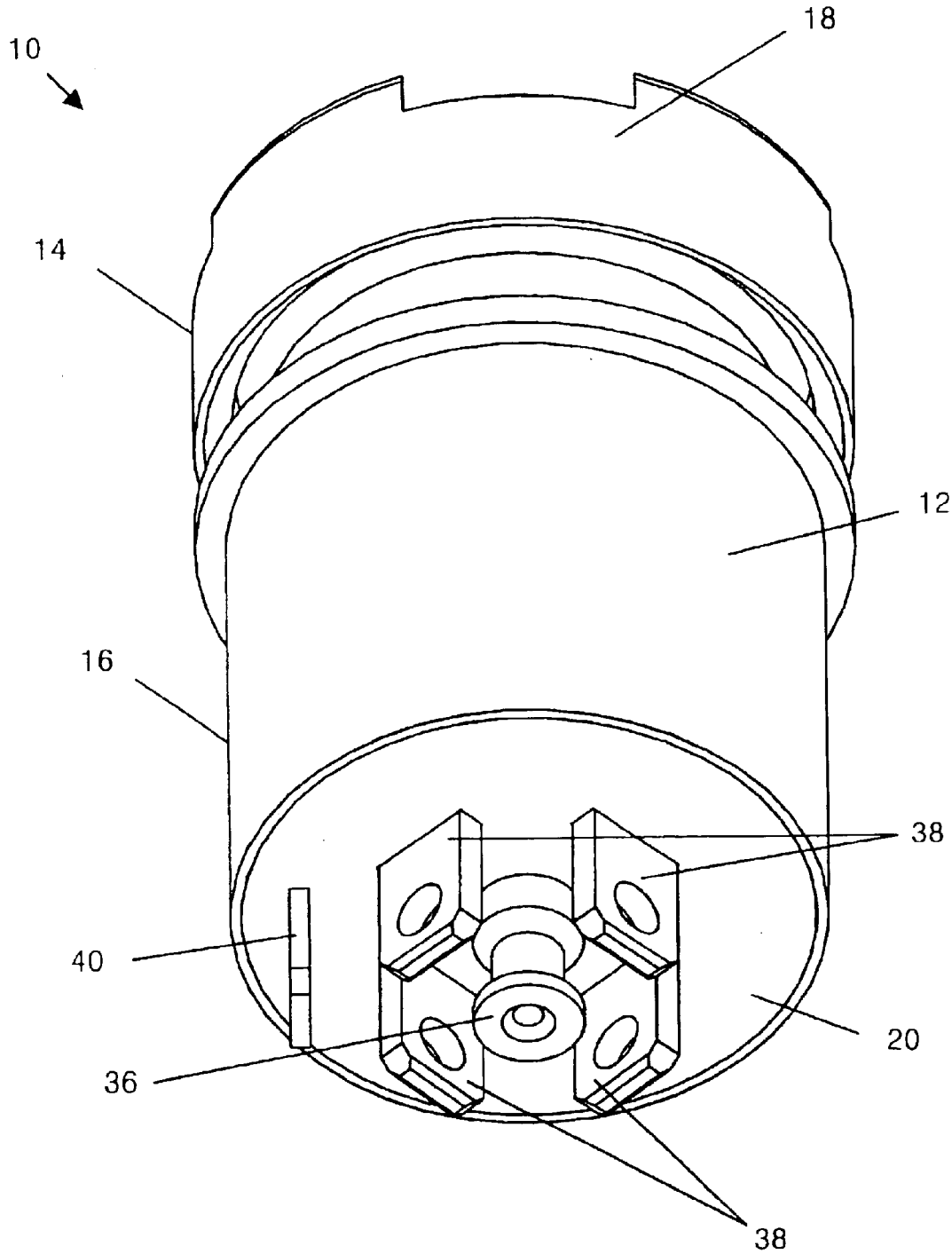
FIG. 1 is a perspective view of a multi-positional switch of the present invention.
Figure 2:
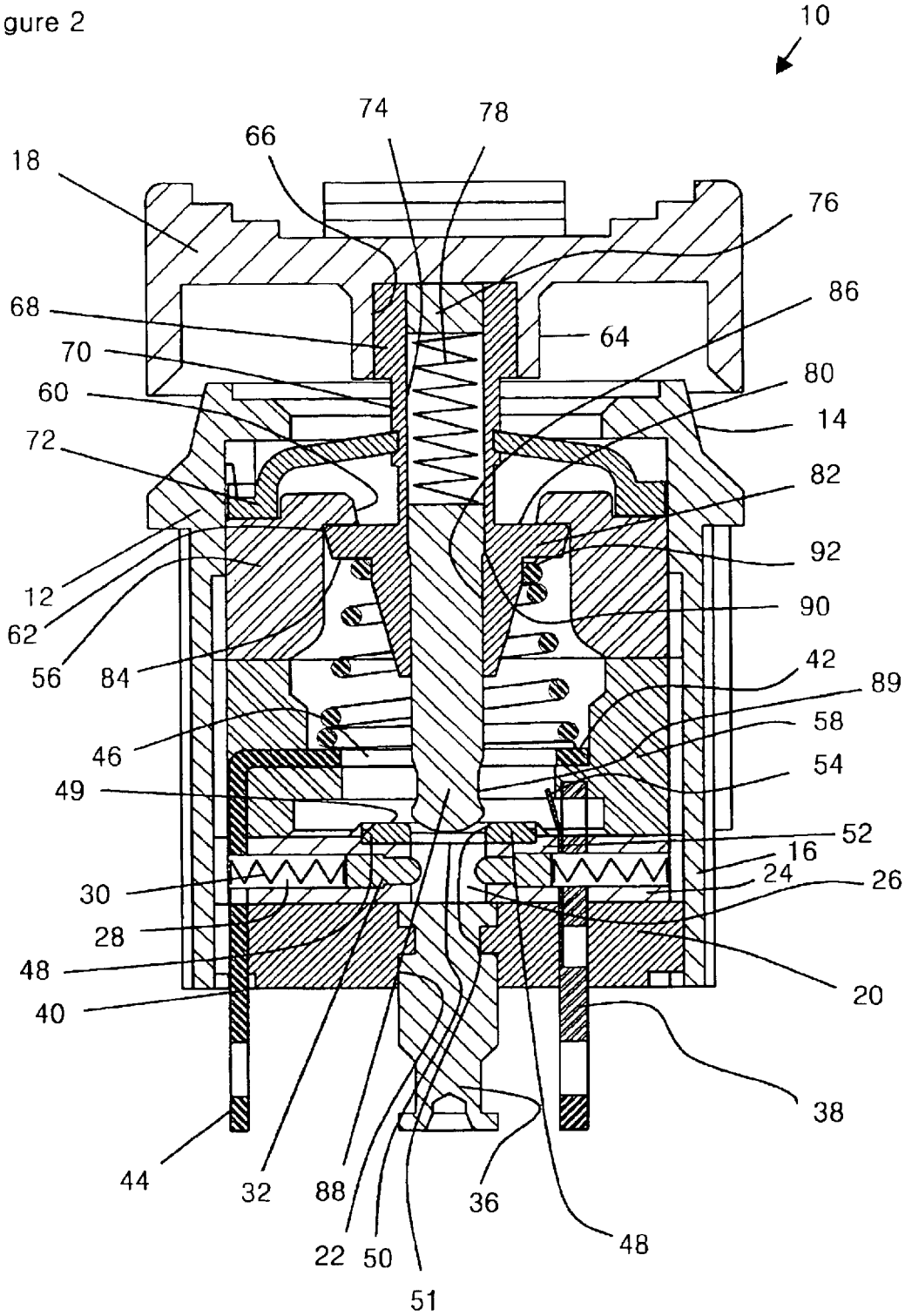
FIG. 2 is a sectional view of the multi-positional switch first shown in FIG. 1.

The multi-positional switch 10 of the present invention, as shown in FIGS. 1 and 2, includes a cylindrical casing or housing 12 having an upper end 14 and an opposite lower end 16. The housing 12 also includes an interior chamber that extends from the upper end 14 to the lower end 16 for containing structural elements hereinafter further described. Mounted at the upper end 14 of the housing 12 is a push button 18 for selective depression and release by the operator for engagement to and disengagement from various switching positions in order to achieve electrical sensitivity and connection with other mechanical and/or electrical elements for operating the aircraft. Secured to the lower end 16 of the housing 12 is a lower enclosure plate 20, and the lower enclosure plate 20 includes a plurality of slots or channels radially arranged about a central opening 22 that extends through the lower enclosure plate 20. Disposed inboard of the lower enclosure plate 20, and contiguous thereto, is support housing 24. The support housing 24 includes a support housing opening 26 that is axially aligned with the central opening 22 of the lower enclosure plate 20. A blind hole 28 is formed in the body of the support housing 24 and is extends inward and perpendicular to the support-housing opening 26. Located within the blind hole 28 is a resistance pin compression spring 30 and a resistance pin 32, both of which will be hereinafter described. The resistance pin 32 is capable of linear reciprocable movement therein and can extend partially into the support housing opening 26 of the support housing 24 when in its non-engaged disposition. The interior annular wall of the blind hole 28 also includes a stopping ledge or sill 34 that delimits the range of linear movement of the resistance pin 32.

As shown in FIGS. 1–10, a common central terminal 36 is mounted to the central opening 22 of the lower enclosure plate 20 and partially projects therefrom external to the housing 12. In addition, one or more terminals 38 are mounted to the lower enclosure plate 20 and the support housing 24. The terminals 38 extend through aligned channels or slots of the lower enclosure plate 20 and the support housing 24 within the chamber of the housing 12 and the terminals 38 also protrude exterior to the housing 12 for making electrical contact with other electrical circuitry and elements for aircraft operation. The terminals 38 are radially arranged about the central terminal 36. In addition, an L-shaped common terminal member 40 that may serve as the ground is mounted to the lower enclosure plate 20 and the support housing 24. The common terminal member 40 includes an annular portion 42 that is disposed within the chamber of the housing 12 and a rectilinear portion 44 extending downwardly through the lower enclosure plate 20 and externally from the lower end 16 of the housing 12. The annular portion 42 further defines an aperture 46 that is disposed in axial alignment with the common central terminal 36.

Figure 3A:
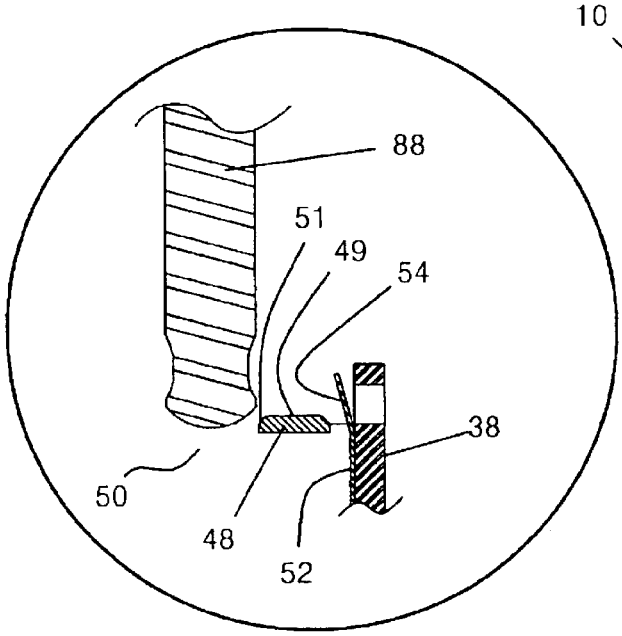
FIG. 3*a* is a portion of a view of FIG. 3*b* enlarged for magnification purposes of a drive stem of the multi-positional switch first shown in FIG. 1.
Figure 3B:
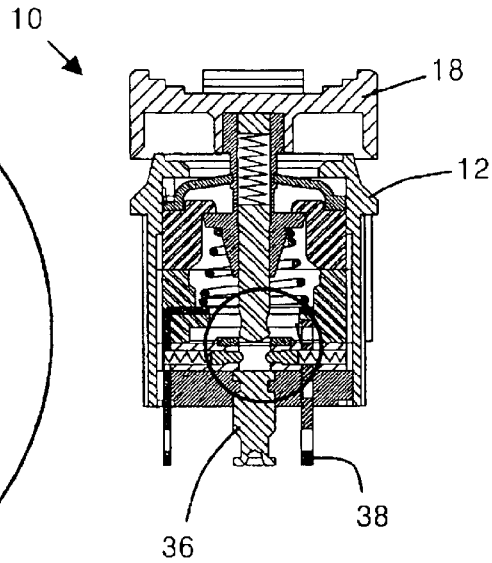
FIG. 3*b* is sectional view of the multi-positional switch to be toggled for engaging a radially disposed contact terminal.
Figure 4A:
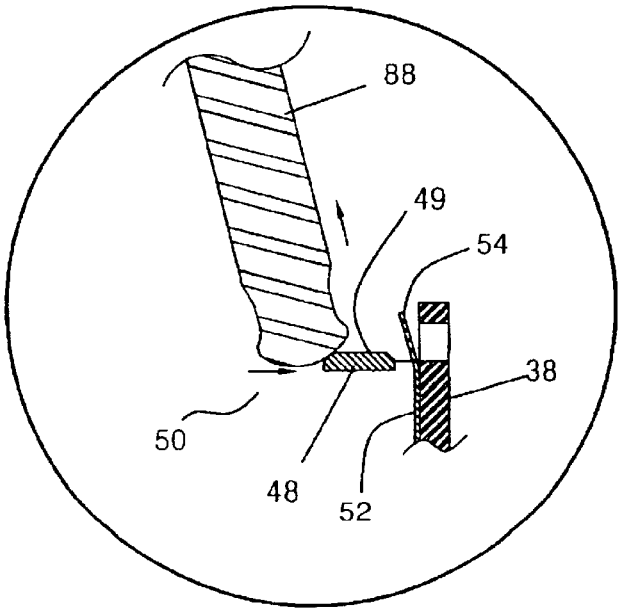
FIG. 4*a* is a portion of a view of FIG. 4*b* enlarged for magnification purposes of the drive stem toggled against a toggle plate.
Figure 4B:
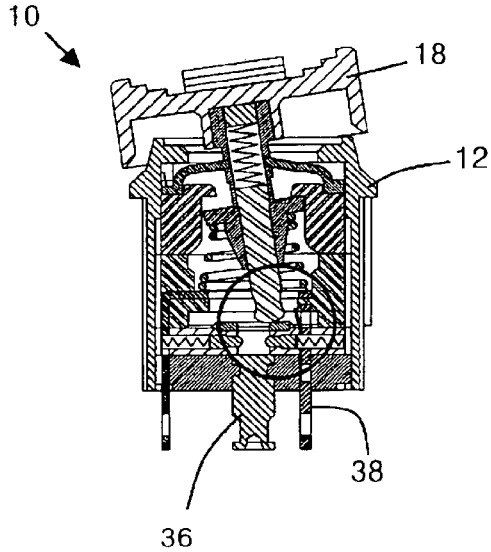
FIG. 4*b* is a sectional view of the multi-positional switch toggled against the toggle plate.
Figure 5A:
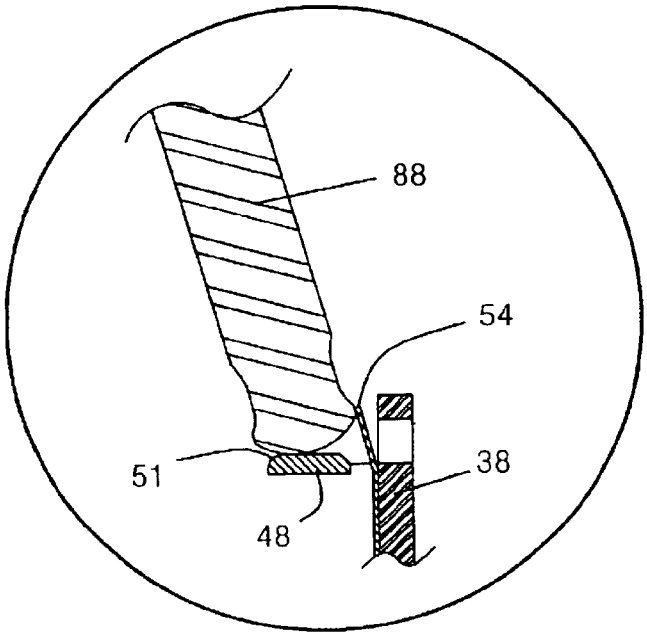
FIG. 5*a* is a portion of a view of FIG. 5*b* enlarged for magnification purposes showing the toggling of the drive stem over the toggle plate.
Figure 5B:
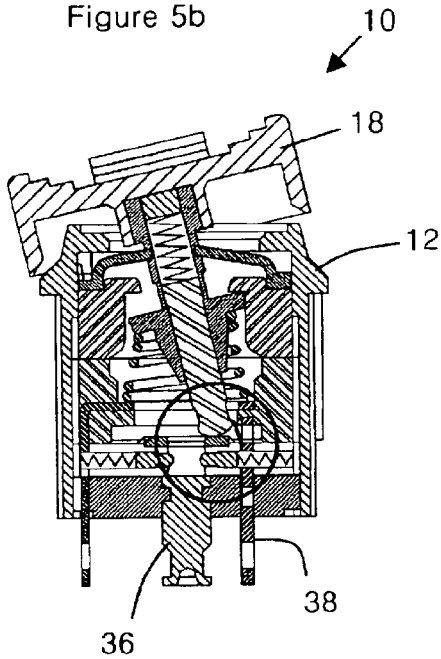
FIG. 5*b* is a sectional view of the multi-positional switch toggling over the toggle plate.
Figure 6A:
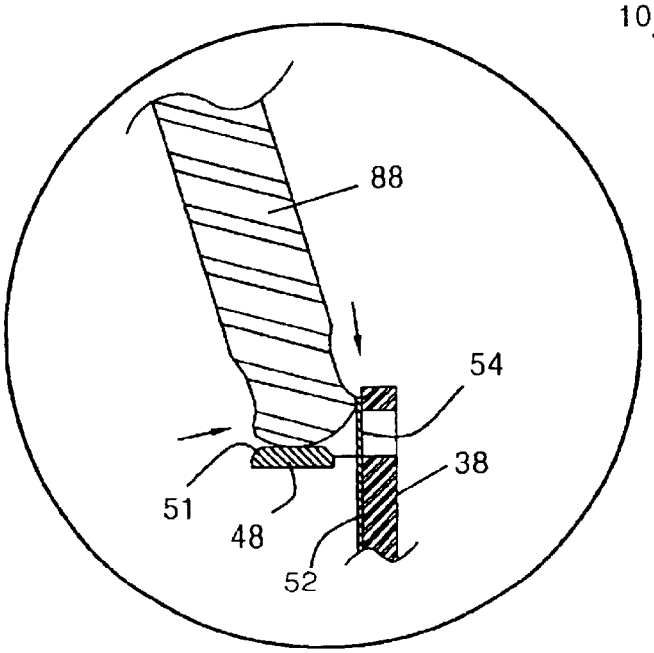
FIG. 6*a* is a portion of a view of FIG. 6*b* enlarged for magnification purposes showing the engagement of the drive stem against a bent portion of one auxiliary contact.
Figure 6B:
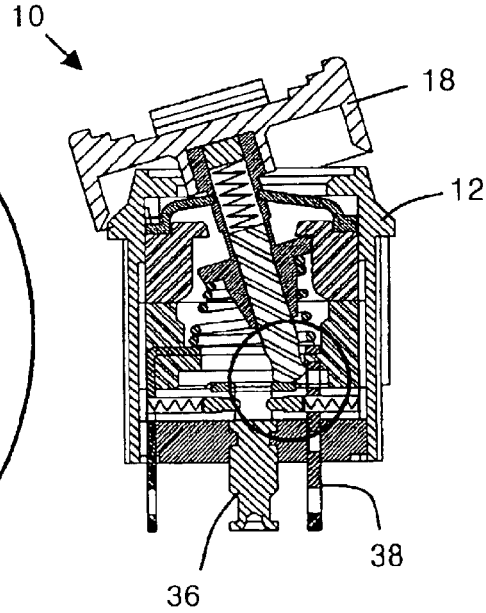
FIG. 6*b* is a sectional view of the multi-positional switch contacting the bent portion of the auxiliary contact.
Figure 7A:
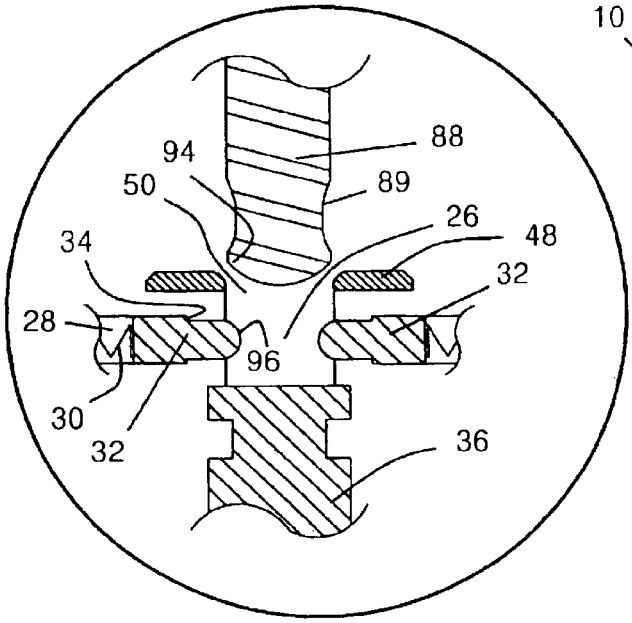
FIG. 7*a* is a portion of a view of FIG. 7*b* enlarged for magnification purposes showing the drive stem as the drive stem is positioned for engaging a central terminal.
Figure 7B:
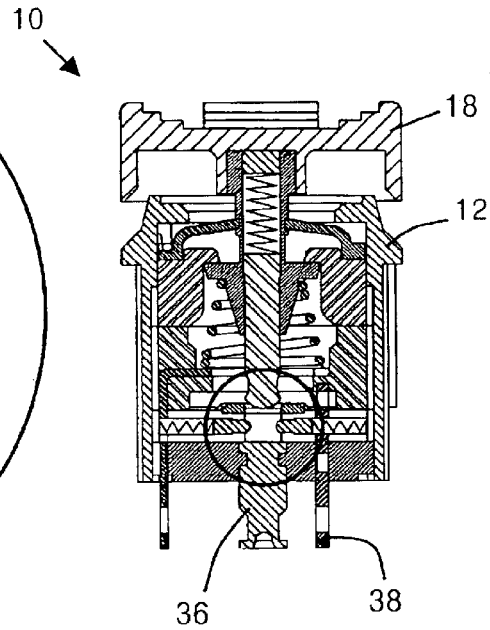
FIG. 7*b* is a sectional view of the multi-positional switch.

Illustrated in FIGS. 2–10 is a switching or toggle plate 48 mounted on the support housing 24 and in axial alignment with the support housing 24 and the central terminal 36 that is secured to the lower enclosure plate 20. The toggle plate 48 includes a toggle plate surface 49, a toggle plate aperture 50, and a toggle plate entry chamfer 51. The toggle plate aperture 50 is axially aligned with the central terminal 36. Adjoined to and in electrical contact with the portion of the terminals 38 that project within the chamber of the housing 12 adjacent the toggle plate 48 are a plurality of auxiliary contacts 52. One auxiliary contact 52 is adjoined to each terminal 38. Each auxiliary contact 52 has an interior pliable bent or angled portion 54 that is capable of being brought into contact with the inner portion of the respective terminal 38 to which it is adjoined. The angled portion 54 of each auxiliary contact 52 is pliable; the non-engaged state is shown in FIGS. 2–4 and the electrically engaged state is shown in FIGS. 5 and 6.

As shown in FIG. 2, the switch 10 includes a pair of annular interior sleeves that abut the inside surface of the housing 12 for supporting structural elements hereinafter further described. Specifically, the sleeves include a guide shaft mounting sleeve 56 and a terminal support sleeve 58. The sleeves 56 and 58 are axially aligned with each other, and the terminal support sleeve 58 abuts the circular portion 42 of the common terminal member 40. The guide shaft mounting sleeve 56 includes an inner annular protrusion 60 that is further defined by an interior annular ledge 62.

As shown in FIG. 2, the push button 18 includes an interior boss 64 that has an inner cavity or recess 66 formed therein. Mounted to the inner cavity 66 of the boss 64 is a flexible and slightly deformable cap 68. The cap 68 is deformable and pliable to permit toggling of the push button 18 by the operator in both the axial and radial directions. The cap 68 includes a stem portion 70 and a disc portion 72 integrally formed to the stem portion 70. The rim of the disc portion 72 rests within an outer annular channel of the guide shaft mounting sleeve 56. The stem portion 70 also includes an interior stem bore 74 and a stopper 76 is placed within the bore 74 at the location where the bore 74 registers with the interior cavity 66 of the push button 18. Also disposed within the interior stem bore 74 is a drive stem compression spring 78, and, as shown in FIG. 2, one end of the drive stem compression spring 78 is seated on the stopper 76.

With reference to FIG. 2, adjoined to the stem portion 70 of the pliable cap 68 is a guide shaft 80. The guide shaft 80 includes an annular portion 82 having an interior flange 84 and a tapered or conical portion. When the guide shaft 80 is in the non-engaged state, the annular portion 82 abuts the interior ledge 62 of the guide shaft mounting sleeve 56. The guide shaft 80 further includes an inner passageway 86 that is in axial alignment with the annular bore 74 of the stem portion 70 of the cap 68 as shown in FIG. 2. Although the cap 68 and guide shaft 80 are two separate elements in the preferred embodiment, it is readily conceivable that the guide shaft 80 and the cap 68 could be manufactured as a unitary component and function in the same manner as the embodiment herein disclosed.

As shown in FIGS. 2–10, a drive shaft or stem 88 is disposed within the bore 74 of the cap 68 and the inner passageway 86 of the guide shaft 80. The drive stem 88 is seated on one end of the drive stem compression spring 78 and travels downward toward the toggle plate 48 when the push button 18 is depressed for engaging the terminals 38 or the central contact terminal 36. In order to limit downward movement, the drive stem 88 includes a stopping sill or neck 90 that contacts the annular wall of the passageway 86 of the guide shaft 80. The outside diameter of the drive stem 88 is sized so that the drive stem 88 can slide through the aperture 46 of the common terminal member 40 and the opening 26 of the support housing 24 for engaging the central contact terminal 36 as illustrated in FIGS. 7–10. Thus, the drive stem 88 is capable of selective linear reciprocable movement within the guide shaft sleeve 56 and the terminal support sleeve 58 concomitant with and actuated by the depression and toggling of the push button 18 to attain the various switching positions. The drive stem 88 includes a recess 89 into which the resistance pin 32 may seat. The drive stem 88 also includes a curved or rounded end 94, which contacts a curved or rounded end 96 of the resistance pin or sliding plate 32 for facilitating the forcing of the resistance pin 32 by the drive stem 88 back into the hole 28.

A primary or main compression spring 92 is disposed within the housing 12 and encompassed by the guide shaft mounting sleeve 56 and the terminal support sleeve 58. The primary compression spring 92 is disposed circumjacent the drive stem 88 with a first end of the primary spring 92 abutting the interior flange 84 of the guide shaft 80 and an opposite second end seated on the annular portion 42 of the common terminal member 40.

The number of contact terminals 38 and 36 may be varied for providing a switch having multiple switching positions. For example, one centrally disposed contact terminal 36 would provide 1-way switching. Two radially disposed contact terminals 38 positioned to the right and left of the centerline of the switch would provide 2-way switching. Four radially disposed contact terminals 38 installed right and left and back and front of the centerline of the switch would provide 4-way switching possible. One axially disposed contact terminal 36 and two radially disposed contact terminals 38 would provide 3-way switching and one axially disposed contact terminal 36 and four radially disposed contact terminals 38 would provide 5-way switching. Any other desirable combination of contact terminals may be used to provide the desired number of switching positions.

With reference to FIGS. 3–6, the operation of the push button 18 for toggling in a radial manner to bring the drive stem 88 in engagement with the toggle plate 48 and then in engagement with the auxiliary contacts 52 and the terminals 38 will first be described. If the operator depresses the push button 18 in a radial. direction, the cap 68 slightly deforms to allow the concomitant angled or rotational movement of the guide shaft 80 and drive stem 88. The rounded end of the drive stem 88 initially comes in contact with the toggle plate 48 as shown in FIG. 4. Continued depression of the push button 18 is impeded but the operator, by maintaining pressure on the push button 18, causes the drive stem 80 to overcome the force of the primary spring 92 and thus the drive stem 88 continues to travel on the surface of the toggle plate 48 as shown in FIGS. 3 and 4. The additional pressure on the push button 18 can be easily sensed by the operator as an immediate tactile sensation conveyed by the operator's fingers.

As shown in FIG. 5, the continued movement of the drive stem 88 along the surface of the toggle plate 48 causes the drive stem 88 to contact the angled portion 54 of one auxiliary contact 52 adjoined to that respective terminal 38. The force applied by the drive stem 88 causes the drive stem 88 to bend the angled portion 54 back against the auxiliary contact 52. Since each contact 52 is connected to one respective terminal 38 for electrical sensing and conduction, the drive stem 88 becomes electrically sensitive with that respective terminal 38 upon attaining the position illustrated in FIG. 6. By continuously pressing the push button 18 the drive stem 88 is maintained in the state shown in FIG. 6 and thus a very stable electrical sensitivity is achieved. With the terminals 38 arranged about the common central terminal 36 as shown in FIG. 1, the present invention provides for a five position switch. The aforedescribed actions would be repeated were the operator to toggle the push button 18 and guide shaft 80 in order to bring the drive stem 88 into contact with any of the other terminals 38. When the force of the drive stem 88 against the bent portion 54 of the auxiliary contact 52 is released, the bent portion 54 returns to the angled disengaged state as shown in FIGS. 3 and 4.

Figure 8A:
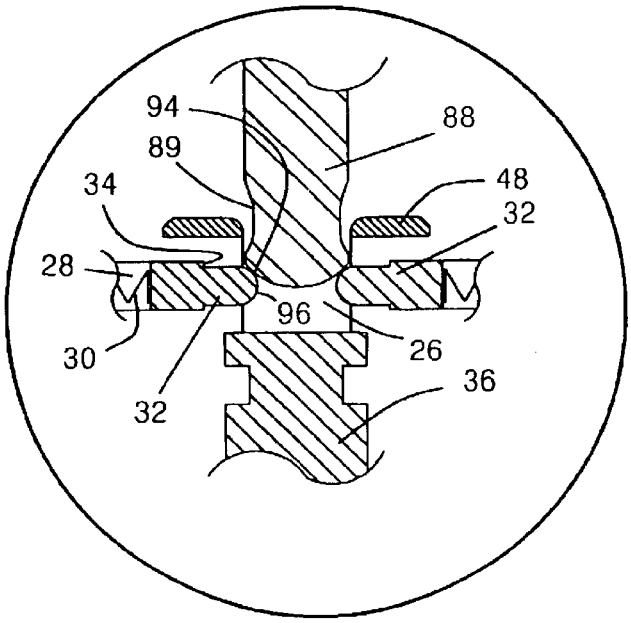
FIG. 8*a* is a portion of a view of FIG. 8*b* enlarged for magnification purposes showing the drive stem as the drive stem passes through an aperture of the toggle plate.
Figure 8B:
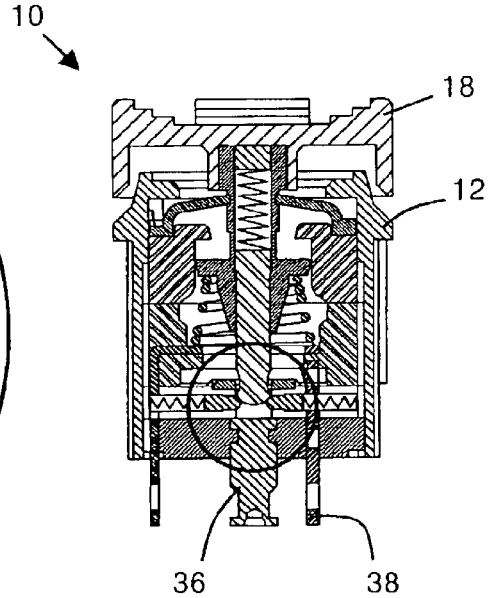
FIG. 8*b* is a sectional view of the multi-positional switch passing through the aperture of the toggle plate.
Figure 9A:
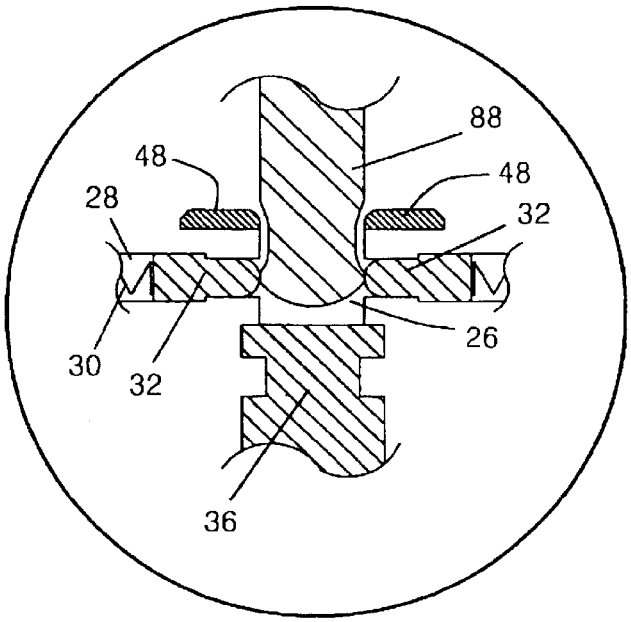
FIG. 9*a* is a portion of a view of FIG. 9*b* enlarged for magnification purposes showing the drive stem as the drive stem encounters resistance from a resistance pin during downward travel of the drive stem.
Figure 9B:
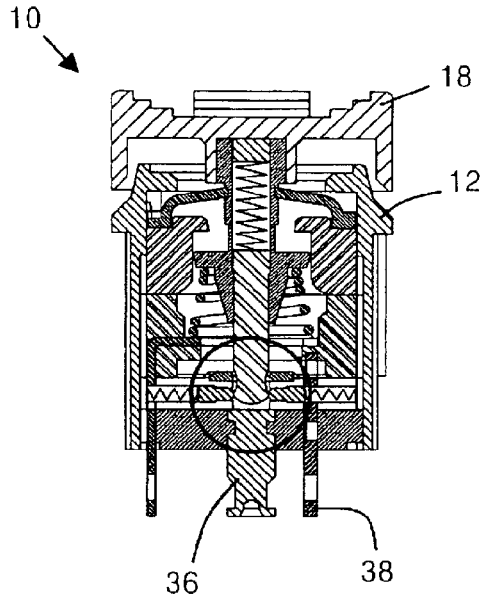
FIG. 9*b* is a sectional view of the multi-positional switch contacting the resistance pin.

With reference to FIGS. 7–10, the actions that bring the drive stem 88 into electrical engagement with the common central terminal 36 will now be described. In the standard position the drive stem 88 will be in axial alignment with the aperture 50 of the toggle plate 48, the opening 26 of the support housing 24 and the common central terminal 36. When the operator depresses the push button 18 in the linear downward direction the drive stem 88 passes through the aperture 50 of the toggle plate 48. The continued downward travel of the drive stem 88 is initially hindered by the resistance pin 32 that juts into the opening 26 of the support housing 24. As the drive stem 88 travels downward the primary spring 92 is further compressed thereby increasing the potential elastic restorative force inherent in the primary spring 92. When the restoring force of the primary spring 92 exceeds the resistive force of the resistance pin 32 resulting from the extension of the compression spring 30 within the hole 28, the downwardly directed force of the drive stem 88 is able to force the resistance pin 32 back into the hole 28 as shown in FIGS. 8 and 9. The drive stem 88 then proceeds downward past the resistance pin 32 with the assistance of the primary spring 92 until the end of the drive stem 88 comes into contact with the common central terminal 36.

Figure 10A:
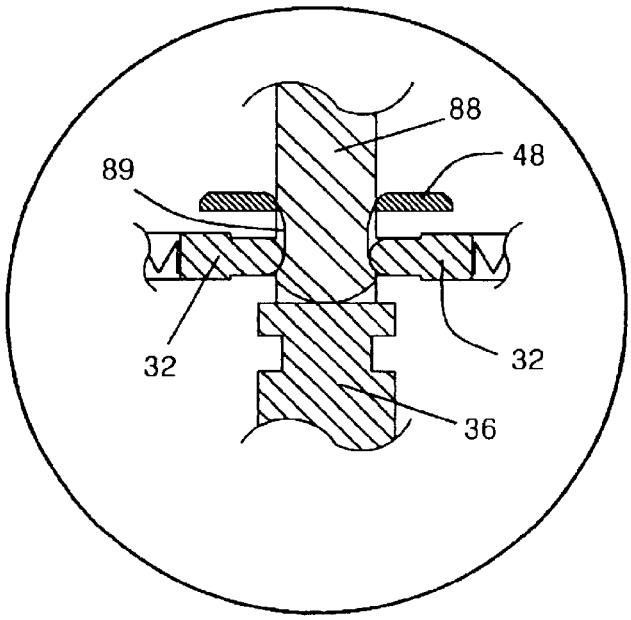
FIG. 10*a* is a portion of a view of FIG. 10*b* enlarged for magnification purposes showing the drive stem in engagement with the central contact terminal.
Figure 10B:
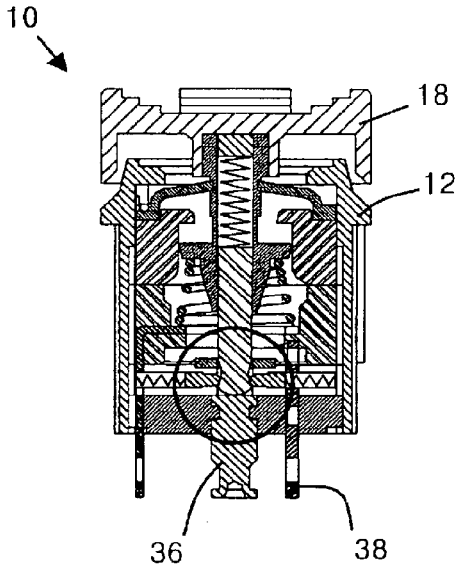
FIG. 10*b* is a sectional view of the multi-positional switch contacting the central contact terminal.

As shown FIGS. 9 and 10, the operator continues depressing the push button 18 thereby maintaining the downwardly directed force on the drive stem 88 which forces the resistance pin 32 to slide back into the hole 28 thus allowing the drive stem 88 to pass thereby. Once the resistance pin 32 has been forced to withdraw from the support opening 26, the drive stem 88 will continue to proceed downward but now through the application of less force and with the assistance of the accumulated restoring force of the spring 92. FIG. 10 illustrates the furthest downward position of the drive stem 88 wherein the drive stem 88 is disposed in electrical connection to the common terminal member 40. The operator can easily and quickly perceive the state of being switched by the significant decrease in the applied force as the drive stem 88 travels past and clears the resistance pin 32 for electrical engagement with the common terminal member 40. The drive stem 88 and the guide shaft 80 return to their disengaged state by the relaxation of the primary spring 92 upon the operator releasing his or her finger from the push button 18.

The foregoing description discloses and describes a preferred embodiment for the invention, and those skilled in the art will understand that other variations and modifications may be possible and practicable, and still come within the ambit of the invention.

I claim:

1. A multi-positional switch for providing an operator with tactile sensing in order for the operator to determine the various switching positions of the switch, comprising:

a housing having an upper end and an opposite lower end;

an axially disposed contact terminal secured to the lower end of the housing and projecting externally therefrom;

a plurality of radially disposed contact terminals secured to the lower end of the housing and projecting externally therefrom;

a push button mounted to the upper end of the housing and capable of selective depression and toggling in axial and radial directions when manipulated by the operator;

a drive stem coupled to the push button and capable of selective slidable linear and radial motion as a result of the depression and toggling of the push button;

a toggle plate disposed within the housing adjacent the lower end and having a toggle plate aperture and an entry chamfer through which the drive stem can pass whereupon depression of the push button in the axial direction causes the drive stem to pass through the toggle plate aperture and toggling the push button in a radial direction causes the drive stem to slide against the entry chamfer for providing resistance to movement of the push button for conveying a tactile sensation to the operator as the push button is toggled into engagement with one of the plurality of radially disposed contact terminals; and a resistance pin disposed within the housing adjacent the lower end and between the toggle plate and the axially disposed contact terminal, the resistance pin positioned perpendicular to the drive stem so that the forcible contact of the drive stem against the resistance pin is conveyed to the operator through tactile sensing in order for the operator to determine that the drive stem has been brought into engagement with the axially disposed contact terminal.

2. The multi-positional switch according to claim 1, further comprising:

a pliable cap disposed within the housing and secured to the push button whereby the cap moves in axial and radial directions concomitant with the depression and toggling of the push button, and a guide shaft mounted to the pliable cap and movable in axial and radial directions concomitant with the movement of the cap, the guide shaft having a passageway that is coaxial with the housing when the push button is in the non-depressed state.

3. The multi-positional switch according to claim 2, further comprising a primary spring disposed within the housing encompassing the drive stem and seated on the guide shaft for facilitating the movement of the drive stem against and past the resistance pin and for returning the drive stem to the non-engaged state when the operator releases the push button.

4. The multi-positional switch according to claim 1, wherein:

the housing includes a hole positioned perpendicular to the drive stem for disposition of the resistance pin; and the resistance pin positioned extending from the hole whereupon the axial movement of the drive stem from the depression of the push button forcibly contacts the resistance pin and causes the resistance pin to retract back into the hole so that the drive stem can pass by the resistance pin and can engage the axially disposed contact terminal.

5. The multi-positional switch according to claim 4, further comprising a compression spring positioned within the hole and attached to the resistance pin for providing tension on the spring and enabling the spring to extend from the hole and to retract back into the hole.

6. The multi-positional switch according to claim 1, wherein the radially disposed contact terminal further comprises an auxiliary contact having an angled portion which is bendable for providing the engagement of the drive stem and the contact terminal.

7. The multi-positional switch according to claim 1, wherein the toggle plate includes a surface positioned substantially perpendicular to the contact terminal and positioned adjacent to and extending from the entry chamfer, the drive stem sliding over the surface of the toggle plate into contact with one of the plurality of radially disposed contact terminals.

8. The multi-positional switch according to claim 1, wherein the drive stem includes a recess, the resistance pin extendable into the recess of the drive stem as the push button is depressed extending the drive stem into contact with the axially disposed contact terminal.

9. The multi-positional switch according to claim 1, wherein:

the axially disposed contact terminal includes one centrally positioned contact terminal; and the plurality of radially disposed contact terminals include two radially disposed contact terminals for providing 3-way switching including two horizontal directions and a downward direction.

10. The multi-positional switch according to claim 1, wherein:

the axially disposed contact terminal includes one centrally positioned contact terminal; and the plurality of radially disposed contact terminals include four radially and equally spaced contact terminals for providing a five position switch.

11. A multi-positional switch for aircraft for providing the operator with tactile sensing for determining the various switching states of the switch, comprising:

a housing having an upper end and an opposite lower end;

a plurality of electrical contact terminals secured to the lower end of the housing in both axial and radial dispositions and protruding externally therefrom;

a push button mounted to the upper end of the housing and capable of selective toggling and depression in the axial and radial directions when depressed by the operator;

a toggle plate mounted within the housing adjacent the lower end and having an entry chamfer and a toggle plate aperture coaxial with the push button when the switch is in the non-depressed state;

a longitudinally extending drive stem capable of slidable, linear movement within the housing concomitant with the depression of the push button in the axial direction and the toggling of the push button in radial directions;

the drive stem passing through the toggle plate aperture when the push button is depressed in the axial direction for engaging one of the plurality of electrical contact terminals and slidable on the entry chamfer of the toggle plate by the operator toggling the push button so that the drive stem can contact another of the plurality of electrical contact terminals; and the push button toggled in the radial direction causing the drive stem to slide against the entry chamfer of the toggle plate for providing resistance to movement of the push button for conveying a tactile sensation to the operator as the push button is toggled into engagement with one of the plurality of electrical contact terminals so that the operator can determine the particular switching position of the switch through touch sensing.

12. The multi-positional switch according to claim 11, further comprising a resistance pin disposed within the housing adjacent the lower end, the resistance pin positioned substantially perpendicular to the drive stem so that the forcible contact of the drive stem against the resistance pin is conveyed to the operator through tactile sensing in order for the operator to determine that the drive stem has been brought into engagement with one of the plurality of electrical contact terminals.

13. The multi-positional switch according to claim 12, wherein:

the housing includes a hole positioned perpendicular to the drive stem for disposition of the resistance pin; and the resistance pin positioned extending from the hole whereupon the axial movement of the drive stem from the depression of the push button forcibly contacts the resistance pin and causes the resistance pin to retract back into the hole so that the drive stem pass by the resistance pin and can engage the axially disposed contact terminal.

14. A multi-positional switch, comprising:

a housing having an upper end and an opposite lower end;

at least one contact terminal secured to the lower end of the housing and projecting externally therefrom;

a push button mounted to the upper end of the housing and capable of selective movement when manipulated by the operator;

a drive stem disposed within the housing and coupled to the push button, the drive stem capable of radial motion as a result of the toggling of the push button; and a toggle plate disposed within the housing adjacent the lower end and having a toggle plate aperture and an entry chamfer, contact of the drive stem against the entry chamfer provides resistance to movement of the drive stem which conveys a tactile sensation to an operator as the drive stem slides over the toggle plate for electrically engaging the at least one contact terminal for providing the operator with tactile sensing in order for the operator to determine various switching positions of the switch.

15. The multi-positional switch according to claim 14, wherein the at least one contact terminal includes at least two radially disposed contact terminals secured to the lower end of the housing and projecting externally therefrom for providing at least two way switching.

16. The multi-positional switch according to claim 14, wherein the at least one contact terminal includes four radially disposed contact terminals secured to the lower end of the housing and projecting externally therefrom for providing a four way switch.

17. The multi-positional switch according to claim 14, further comprising:

the at least one contact terminal including an axially disposed contact terminal secured to the lower end of the housing and projecting externally therefrom; and a resistance pin disposed within the housing adjacent the lower end and perpendicular to the drive stem so that the forcible contact of the drive stem against the resistance pin is conveyed to the operator through tactile sensing in order for the operator to determine that the drive stem has been brought into engagement with the axially disposed contact terminal.

18. The multi-positional switch according to claim 17, wherein:

the housing includes a hole positioned perpendicular to the drive stem for disposition of the resistance pin; and the resistance pin positioned extending from the hole whereupon the axial movement of the drive stem from the depression of the push button forcibly contacts the resistance pin and causes the resistance pin to retract back into the hole so that the drive stem can pass by the resistance pin and can engage the axially disposed contact terminal.

19. The multi-positional switch according to claim 14, wherein the at least one contact terminal includes an axially disposed contact terminal and at least one radially disposed contact terminal secured to the lower end of the housing and projecting externally therefrom for providing the multi-positional switch.

20. The multi-positional switch according to claim 19, further comprising a primary spring disposed within the housing encompassing the drive stem and seated on the guide shaft for facilitating the movement of the drive stem against and past the resistance pin and for returning the drive stem to the non-engaged state when the operator releases the push button.

* * * * *